United States Patent [19]

Guiol

[11] Patent Number: 4,871,883

[45] Date of Patent: Oct. 3, 1989

[54] ELECTRO-MAGNETIC SHIELDING

[75] Inventor: Eric Guiol, Pleinfeld, Fed. Rep. of Germany

[73] Assignee: W. L. Gore & Associates, Inc., Newark, Del.

[21] Appl. No.: 76,623

[22] Filed: Jul. 23, 1987

[30] Foreign Application Priority Data

Jul. 29, 1986 [DE] Fed. Rep. of Germany ..... 3625631

[51] Int. Cl.[4] ..... H01B 7/34

[52] U.S. Cl. ..... 174/36; 174/35 MS; 333/243

[58] Field of Search ..... 174/35 MS, 36; 333/12, 333/243; 252/512; 342/1

[56] References Cited

U.S. PATENT DOCUMENTS

| | | | |
|---|---|---|---|
| 2,875,435 | 2/1959 | McMillon | 174/35 MS |
| 2,954,552 | 9/1960 | Halpern | 342/1 |
| 3,007,160 | 10/1961 | Halpern | 342/1 |
| 3,191,133 | 6/1965 | Mayer | 333/181 |
| 3,309,633 | 3/1967 | Mayer | 333/184 |
| 4,024,318 | 5/1977 | Forster et al. | 342/1 X |
| 4,301,428 | 11/1981 | Mayer | 174/36 X |
| 4,376,920 | 3/1983 | Smith | 174/36 X |
| 4,383,225 | 5/1983 | Mayer | 174/36 X |
| 4,629,756 | 12/1986 | Kerbow | 252/512 X |
| 4,727,222 | 2/1988 | Sato | 174/36 X |

FOREIGN PATENT DOCUMENTS

| | | | |
|---|---|---|---|
| 3025504 | 7/1980 | Fed. Rep. of Germany . | |
| 157300 | 12/1980 | Japan | 342/1 |

*Primary Examiner*—Morris H. Nimmo

[57] ABSTRACT

An electro-magnetic shielding comprising at least a two-layered electro-magnetic shielding in which one layer is formed by an electrical conductor, such as a metal braiding shield, and in which second layer is formed by a flexible, electrically non-conductive plastic layer doped with non-magnetic metal particles.

5 Claims, 2 Drawing Sheets

ELECTRO-MAGNETIC SHIELDING

BACKGROUND OF THE INVENTION

1. Field of the Invention:

The invention relates to an electro-magnetic and magnetic shielding and to electrical cables provided therewith.

2. Description of the Prior Art: In the field of high frequency applications, it is frequently necessary to enclose one or more signal conductors of an electrical cable within an electro-magnetic shielding. This is to prevent electro-magnetic radiation from the outside from affecting the signal being transmitted, and similarly to prevent radiation of the signal from affecting the outside.

Cables with single-braided shields frequently are not sufficient for high frequency applications, especially in the lower megahertz range. A better shielding effect is achieved by means of two shields that are braided onto each other. In the case of very high requirements for the shielding effect, as necessary for instance in the fields of astronautics, aeronautics, telecommunications and data processing, even the two-braided shielding is not sufficient. For such fields of application, cables having a three-layered shielding have been provided, in which the inner layer and the outer layer are each formed by a metal braiding or conductive foil shield and the intermediate layer is formed by a polycrystalline material, such as for example mu-metal and metallic glass.

However, shielding structures with three layers result in cables having only limited flexibility and difficulties arise in handling these cables when they are connected to contact elements such as plug and socket connectors. In addition, only shielding of electric fields is achieved. Shielding of magnetic fields is not achieved by the three-layer shielding. Moreover, another disadvantage is that the conductive intermediate layer electrically interconnects with the inner layer and the outer layer resulting in the effect of having only one thick-layered shielding.

German-"Offenlegungsschrift" No. 30 25 504 discloses a coaxial cable comprising a magnetic layer between two metal shields, said magnetic layer consisting of a magnetic mixed material which is non-conductive or slightly conductive only and which can be made by mixing ferrite dust or a different magnetic metallic dust into a flexible plastic carrier material.

U.S. Pat. No. 4,376,920 describes two braided shields of a coaxial cable, an intermediate layer with a high dissipation factor in order to achieve a high propagation function for the path.between the two shield layers and, thus, a shielding effect that is as length-independent as possible. For the intermediate layer, it is possible to use a plastic material providing good electrical insulation and being loaded with lossy pigments or with other compounds that are not specified in detail.

U.S. Pat. Nos. 3,191,132 and 3,309,633 disclose electrical cables whose flexible insulating plastic material surrounding electrical conductors contains an admixture of ferrite particles in order to obtain an absorption of electro-magnetic waves of high frequency, without having an absorption of such waves in the low-frequency range. For applications of the type mentioned here, the shielding damping should be in the range greater than 100 dB in order to prevent radiation disturbing signals.

Electro-magnetic radiation affecting the signal to be transmitted, have a negative effect, especially in digital signals, in that the pulse edges are flattened. This leads to signal distortions and to a reduction of the possible pulse repetition frequency.

In many electronic fields, pulses of radiation from the cable transmitted to other electronic components o signal conductors of other cables is undesired. In the fields of telecommunications and data processing, undesired cross-talk may occur and unauthorized data tapping is rendered possible due to this radiation.

A problem to be solved by the present invention resides in providing an electro-magnetic shielding having high shielding damping both of electrical and magnetic fields in a frequency range as wide as possible, and in addition providing a highly flexible cable structure.

Figure 1:
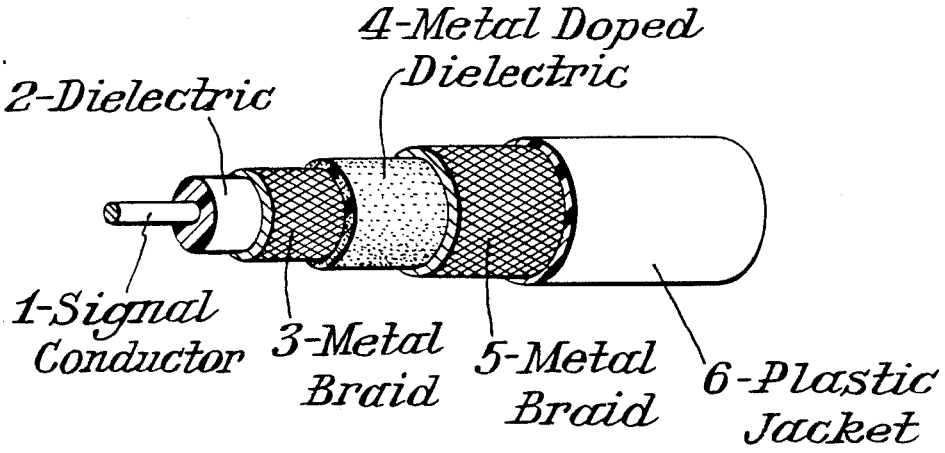
FIG. 1 illustrates a construction of an embodiment of the invention.

DETAILED DESCRIPTION OF THE INVENTION:

This invention relates to an electro-magnetic shielding having at least two shielding layers, one of which is formed by an electrical conductor in the form of a metal braid or metal foil and a second shielding layer further comprised of a flexible, metal-doped, or metal loaded, electrically nonconductive plastic layer. Because one layer of the shielding consists of metal-doped plastics material that is highly flexible, the inventive cable provides shielding that has high flexibility. The high quality electro-magnetic shield damping properties are achieved because an externally or internally radiating magnetic field is concentrated in the shielding layer of metal-filled plastics material.

Shielding against interference from electric fields as presently exist such as electrical conductors, are effective in that the electrical conductors form an equipotential surface, which by external connection has a potential of zero. Charge carriers caused by local electric fields flow off immediately bringing about an electric shielding effect. The higher the electrical conductivity, the better the electric shielding effect.

However, such electrical conductors have no or only a very weak shielding effect against magnetic fields. There is virtually no magnetic shielding effect against relatively low frequency ranges, such as the lower megahertz range or even kilohertz range.

Also, because the inventive shielding employs a plastic material for the magnetic shielding layer in which metallic particles are embedded in a manner, the plastic material does not become an "electrical conductive plastics material". This layer, rather, remains an electrical insulator and thus achieves effective shielding with respect to magnetic fields. When however as with cables using present technology, ferrite powder is embedded in the plastic material, a shielding damping effect is achieved which is only slightly above the desired minimum value of 100 dB and only in a relatively small lower frequency range.

When employing non-magnetic metal particles, such as for example copper powder, induced eddy currents caused by the high frequency magnetic field are generated in the metal particles. These eddy currents in turn cause a magnetic field that is opposed to the external magnetic field. Here also, a concentrated bond of the magnetic field to be shielded is provided, as in the case of ferrite doping. However the eddy current intensity and, thus the magnetic shielding effect increase as the magnetic field intensity and frequency increase, thus causing not only greater shielding damping than in the case of ferrite doping, but also achieves an increased range of higher frequencies over which good shielding damping can be achieved.

Particularly good electro-magnetic shielding is achieved with a three-layered configuration whose inner and outer shielding layers are each formed by an electrical conductor, such as a metal braid or a metal foil. The middle layer is formed by a metal-doped plastic layer. The middle layer serves as electrical insulation between the inner and outer electrically conductive shielding layers. The effect thereof is a reflection of the electric field to be shielded, at two shielding layers which are different in electrical aspects. This results in better electric shielding than three electrically conductive shielding layers that are in electrical connection with each other. Thus, with respect to the electric fields to be shielded, the three layers act essentially as one single shielding layer.

In comparison with the existing three-layered shielding having an intermediate shielding layer of ferrite-doped plastic material disposed between two metal braiding shields, the shielding according to the present invention, comprises an intermediate plastic layer loaded with non-magnetic metal particles disposed between two metal braiding shields. This results in a considerably better shielding effect over a very wide frequency range. A cable provided with the electro-magnetic 20 shielding according to the invention also has high flexibility compared to existing three-layered shielding in addition to the excellent shielding effect.

The flexible electrically non-conductive plastic layer doped with non-magnetic metal particles also has an additional inventive significance.

In cases in which shielding of magnetic fields only is of importance, this plastic layer may also be employed in an advantageous manner without electrically shielding shield layers, for example in cables to be shielded magnetically and which are to retain high flexibility. These electro-magnetic shielding embodiments with either a two layered configuration or a three layered configuration as described above may be used with at least one signal conductor to form an electrical cable that has good electro-magnetic and/or magnetic shielding properties.

The invention is best understood by reference to the drawings in which the preferred embodiment is illustrated. FIG. 1 shows a coaxial cable having one single signal conductor 1 surrounded by a dielectric 2. A first shield 3 of metal braiding is stretched around the dielectric 2. The first shield 3 is surrounded by a metal-doped, electrically non-conductive intermediate plastics layer 4 which, in turn, is surrounded by a second shield 5 of metal braiding. The outermost layer of the cable is formed by a plastic jacket 6.

Materials suitable for the metal-doped intermediate plastics layer 4 are preferably PTFE (polytetrafluoroethylene) into which preferably copper powder, is embedded.

Figure 2:
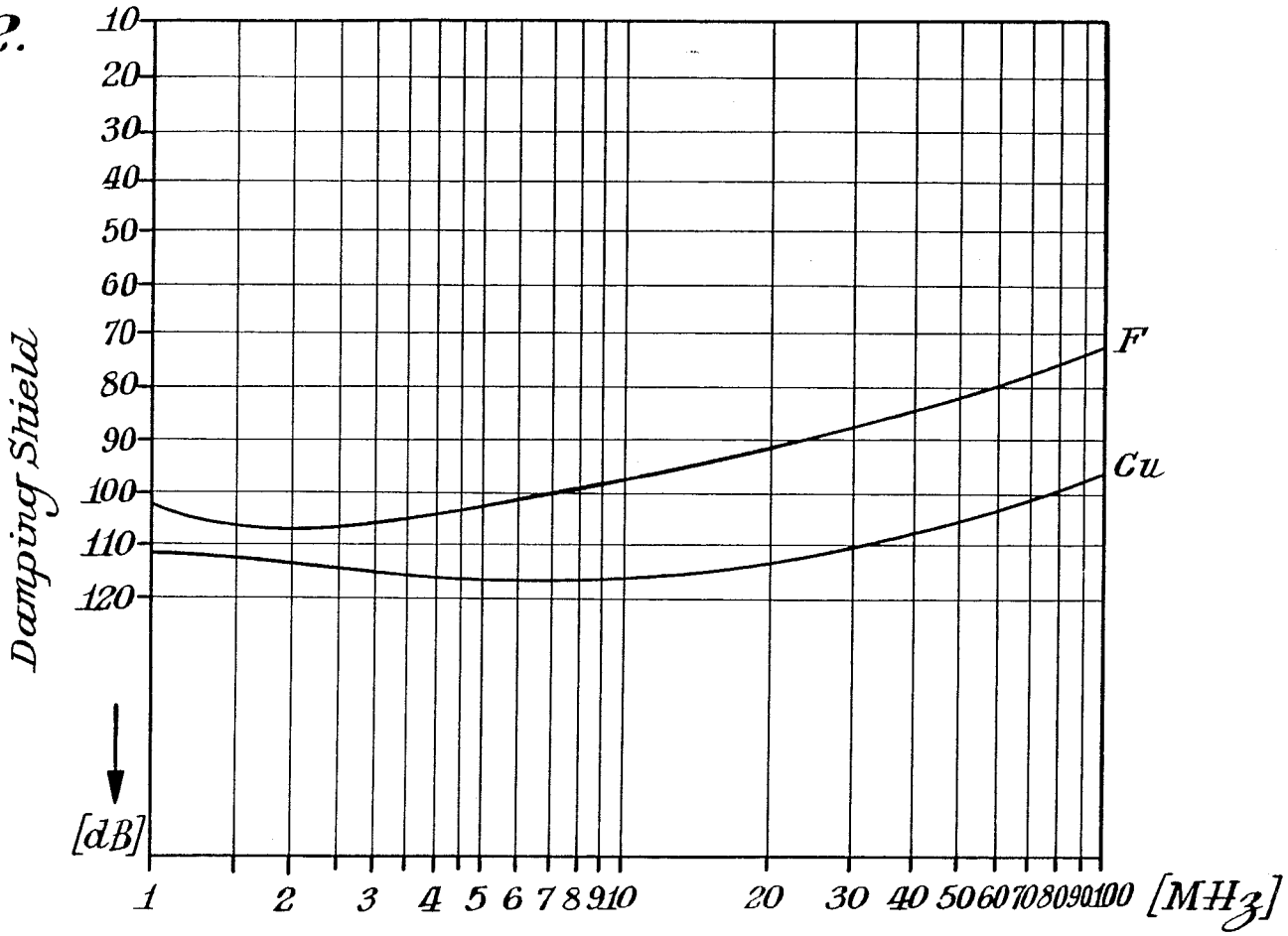
FIG. 2 illustrates shielding damping patterns depending on the frequency for a cable according to an embodiment of the present invention.

Measurements made on various shieldings have led to the following shield damping results in the frequency range of 0.25 megahertz and 110 megahertz:

single-braiding shield: approx. 60 dB two braided shields on top of each other: approx. 85 dB two braided shields over each other, with an intermediate layer there between consisting of plastics material doped with metallic powder: greater than 100 dB FIG. 2 shows a comparison of cables whose intermediate layer 4 is doped with copper particles and identified "Cu" on the curve compared to the cable with a the intermediate layer 4 doped with ferrite particles and identified as "F". The "Cu" curve shows shield damping up to 8 megahertz and a maximum of approximately 107 dB at approximately 2 megahertz. The "F" curve shows shield damping up to approximately 90 megahertz and a maximum of approximately 118 dB at approximately 8 megahertz. Thus it can be seen that the intermediate layer 4 when doped with copper particles display a considerably higher shield damping effect and over a considerably higher frequency range than in the case where the intermediate layer is doped with ferrite particles.

While the invention has been disclosed herein in connection with certain embodiments and detailed descriptions, it will be clear to one skilled in the art that modifications or variations of such details can be made without deviating from the gist of the invention, and such modifications or variations are considered to be within the scope of the claims herein below.

I claim:

1. An electro-magnetic shielded cable comprising at least one signal conductor surrounded by at least two shielding layers, wherein said first shielding layer formed by an electrical conductor in the form of a metal braid and a second shielding layer formed by a flexible, electrically non-conductive layer of polytetrafluoroethylene (PTFE) doped with non-magnetic metal particles.

2. An electro-magnetic shielded cable comprising at least one signal conductor surrounded by at least two shielding layers, wherein said first shielding layer formed by an electrical conductor in the form of a metal foil and a second shielding layer formed by a flexible, electrically non-conductive layer of polytetrafluoroethylene doped with non magnetic metal particles.

3. An electro-magnetic shielded cable according to claim 1 wherein the layer of polytetrafluoroethylene (PTFE) is doped with copper.

4. An electro-magnetic shielded cable according to claim 1 further comprising a third outer shielding layer surrounding the second shielding layer, wherein said outer shielding layer is formed of a metal braid.

5. An electro-magnetic shielded coaxial cable comprising:

a single signal conductor surrounded by a dielectric;

a first shield of metal braiding surrounding said dielectric;

a metal-doped electrically non-conductive intermediate plastic layer, wherein said intermediate plastic layer if PTFE doped with copper powder;

a second shield of metal braiding surrounding said intermediate layer; and an outermost layer further comprising a plastic jacket.

* * * * *